US012193506B2

(12) United States Patent
Shi et al.

(10) Patent No.: US 12,193,506 B2
(45) Date of Patent: Jan. 14, 2025

(54) AEROSOL GENERATION DEVICE AND SUSCEPTOR

(71) Applicant: SHENZHEN FIRST UNION TECHNOLOGY CO., LTD., Shenzhen (CN)

(72) Inventors: Lei Shi, Shenzhen (CN); Jianping Wang, Shenzhen (CN); Hengkun Zhao, Shenzhen (CN); Zuqiang Qi, Shenzhen (CN); Tao Wu, Shenzhen (CN); Jiamao Luo, Shenzhen (CN); Baoling Lei, Shenzhen (CN); Linjian Huang, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 50 days.

(21) Appl. No.: 17/754,803

(22) PCT Filed: Oct. 16, 2020

(86) PCT No.: PCT/CN2020/121617
§ 371 (c)(1),
(2) Date: Apr. 13, 2022

(87) PCT Pub. No.: WO2021/073617
PCT Pub. Date: Apr. 22, 2021

(65) Prior Publication Data

US 2024/0023620 A1 Jan. 25, 2024

(30) Foreign Application Priority Data

Oct. 16, 2019 (CN) ..... 201910981762.7
Jan. 8, 2020 (CN) ..... 202010016971.0
Apr. 30, 2020 (CN) ..... 202010367435.5

(51) Int. Cl.
*A24F 40/465* (2020.01)
*A24F 40/20* (2020.01)
*A24F 40/51* (2020.01)
*A24F 40/53* (2020.01)
*A24F 40/57* (2020.01)

(52) U.S. Cl.
CPC ..... *A24F 40/465* (2020.01); *A24F 40/20* (2020.01); *A24F 40/51* (2020.01); *A24F 40/53* (2020.01); *A24F 40/57* (2020.01)

(58) Field of Classification Search
CPC ..... A24F 40/57; A24F 40/53; A24F 40/51; A24F 40/20; A24F 40/465; A24F 40/70; H05B 6/06; H05B 6/108
See application file for complete search history.

(56) References Cited

U.S. PATENT DOCUMENTS

2018/0303167 A1 10/2018 Basil
2019/0387787 A1* 12/2019 Hejazi ..... A24D 1/20

FOREIGN PATENT DOCUMENTS

CN 102595943 A 7/2012
CN 104933382 A 9/2015
(Continued)

*Primary Examiner* — Jean F Duverne
(74) *Attorney, Agent, or Firm* — Proi Intellectual Property US

(57) ABSTRACT

Provided is an aerosol generation device, the aerosol generation device comprising a chamber for receiving at least some of a smokable material; a magnetic field generator configured to generate a varying magnetic field; a susceptor configured to be penetrated by the varying magnetic field so as to generate heat, thereby heating the at least some smokable material received in the chamber; and a circuit configured to determine the temperature of the susceptor by acquiring a resistance value of the at least some of the material on the susceptor and on the basis of the resistance value. According to the aerosol generation device of the
(Continued)

present application, the temperature of the susceptor is determined by measuring the resistance of the susceptor, and compared with a temperature measuring mode using a temperature sensor, production and preparation are more convenient and rapider, and the temperature measuring effect is more accurate.

17 Claims, 10 Drawing Sheets

(56) References Cited

FOREIGN PATENT DOCUMENTS

| | | | | | |
|---|---|---|---|---|---|
| CN | 107734981 | A | * | 2/2018 | ..... A24F 40/10 |
| CN | 207040894 | U | | 2/2018 | |
| CN | 107920602 | A | | 4/2018 | |
| CN | 108348005 | A | | 7/2018 | |
| CN | 108348005 | A1 | | 7/2018 | |
| CN | 108420117 | A | | 8/2018 | |
| CN | 109330027 | A | | 2/2019 | |
| CN | 109792801 | A | | 5/2019 | |
| CN | 109792801 | A1 | | 5/2019 | |
| CN | 109805446 | A | | 5/2019 | |
| EP | 3542591 | | | 9/2019 | |
| EP | 3462933 | B1 | | 11/2021 | |
| WO | WO-2018002084 | A1 | * | 1/2018 | ..... A24B 15/167 |
| WO | 2018178218 | A1 | | 10/2018 | |
| WO | 2019002613 | A1 | | 1/2019 | |
| WO | WO-2019129553 | A1 | * | 7/2019 | ..... A24B 15/14 |
| WO | WO-2019186670 | A1 | * | 10/2019 | ..... A24F 40/46 |

* cited by examiner

AEROSOL GENERATION DEVICE AND SUSCEPTOR

CROSS REFERENCE TO RELATED APPLICATION(S)

This application claims priorities to Chinese Patent Applications No. 2019109817627, entitled "Aerosol generating device, susceptor and temperature monitoring method" and submitted to China National Intellectual Property Administration on Oct. 16, 2019, No. 2020100169710 entitled "Aerosol generating device, susceptor and control method" and submitted to China National Intellectual Property Administration on Jan. 8, 2020, and NO. 2020103674355 entitled "Susceptor for aerosol generating device, and aerosol generating device" and submitted to China National Intellectual Property Administration on Apr. 30, 2020, the entire contents of which are incorporated herein by reference.

TECHNICAL FIELD

The present disclosure relates to the technical field of heating and nonburning smoking sets, and in particular to an aerosol generation device and a susceptor.

BACKGROUND

Tobacco products (e.g., cigarettes, cigars, etc.) are burning tobaccos to produce tobacco smoke during use. People attempt to make products that release compounds without burning so as to replace the tobacco products burning tobaccos.

An example of this kind of products is a heating device, which heats rather than burns a material to release compounds, for example, the material may be a tobacco product or other non-tobacco products which may contain or not contain nicotine. In known devices, it is required to detect temperature during the heating process of tobacco products. Examples of this kind of products acquire the temperature of a heating element through a sensor attached onto the heating element.

SUMMARY

In order to solve the problem of temperature detection of tobacco product heating devices in the prior art, the embodiment of the present disclosure provides an electromagnetic induction type aerosol generation device which is convenient to produce and manufacture and is accurate in detection of temperature.

In view of the above, one embodiment of the present disclosure provides an aerosol generation device, including:

a chamber, which is used for receiving at least some of a smokable material;

a magnetic field generator, which is configured to generate a varying magnetic field;

a susceptor, which is configured to be penetrated by the varying magnetic field so as to generate heat, thereby heating the at least some of the smokable material received in the chamber; and a circuit, which is configured to determine the temperature of the susceptor by acquiring a resistance value of at least some of the material on the susceptor and on the basis of the resistance value.

In a preferred embodiment, the susceptor includes:

a susceptor portion, which is configured to be penetrated by the varying magnetic field so as to generate heat, thereby heating the at least some of the smokable material received in the chamber; and a conductive track in heat-conducting connection with the susceptor portion, the conductive track having a positive or negative temperature coefficient of resistance; wherein the circuit is configured to determine the temperature of the susceptor by acquiring a resistance value of the conductive track and on the basis of the resistance value.

In a preferred embodiment, the susceptor includes:

an electrically insulating substrate extending at least in part into the chamber, a susceptor material layer formed on the electrically insulating substrate, and a conductive track in heat conduction with the susceptor material layer, wherein the susceptor material layer is configured to be penetrated by the varying magnetic field so as to generate heat, thereby heating the at least some of the smokable material received in the chamber;

the conductive track has a positive or negative temperature coefficient of resistance; and the circuit is configured to determine the temperature of the susceptor by acquiring a resistance value of the conductive track and on the basis of the resistance value.

In a preferred embodiment, the circuit includes:

a first power supply module, which is configured to provide an alternating current to the magnetic field generator, so that the magnetic field generator generates a varying magnetic field;

a second power supply module, which is configured provide to a direct-current detection voltage to the susceptor; and a detection module, which is configured to determine the temperature of the susceptor by detecting a resistance value of the susceptor under the detection voltage and on the basis of the resistance value.

In a preferred embodiment, the susceptor is constructed as a pin, needle or sheet shape extending at least in part along an axial direction of the chamber.

In a preferred embodiment, the susceptor represents a tubular shape, and at least part of an inner surface of the susceptor forms the chamber.

In a preferred embodiment, the susceptor further includes a base portion, and the aerosol generation device provides supporting for the susceptor through the base portion.

In a preferred embodiment, the electrically insulating substrate is constructed as a blade shape extending along the axial direction of the chamber and includes a first surface and a second surface that are opposite to one another along a thickness direction; wherein the susceptor material layer is formed on the first surface, and the conductive track is formed on the second surface.

In a preferred embodiment, the conductive track has two ends provided with an electrical connection part and is electrically connected to the circuit through the electrical connection part.

In a preferred embodiment, the conductive track includes a first portion and a second portion, and the first portion has a higher temperature coefficient of resistance than the second portion; and the electrical connection part is connected to the conductive track through the second part.

In a preferred embodiment, the first portion includes at least one of nickel iron copper alloy, nickel chromium aluminum alloy, nickel chromium copper alloy, platinum or tungsten;

and/or, the second portion includes at least one of gold, silver or copper.

In a preferred embodiment, the aerosol generation device further includes a tubular support, wherein at least part of an inner space of the tubular support forms the chamber;

the magnetic field generator includes an induction coil arranged on an outer surface of the tubular support along an axial direction of the tubular support; and the conductive track is formed on the inner surface of the tubular support.

In a preferred embodiment, an insulating flexible carrier is arranged between the inner surface of the tubular support and the susceptor; and the conductive track is formed on the insulating flexible carrier.

In a preferred embodiment, the susceptor includes:

a susceptor portion, which is configured to be penetrated by the varying magnetic field so as to generate heat, thereby heating the smokable material received in the chamber; and an electrical connection portion arranged on the susceptor portion and configured to be electrically connected to the circuit.

In a preferred embodiment, the electrical connection portion has a positive temperature coefficient of resistance; and the detection module is configured to determine the temperature of the susceptor by detecting a combined resistance value of the susceptor portion and the electrical connection portion and on the basis of the combined resistance value.

In a preferred embodiment, the electrical connection portion includes a first section and a second section that are arranged in sequence, and the first section has a higher temperature coefficient of resistance than the second section; wherein the first section of the electrical connection portion is connected to the susceptor portion; and the second section of the electrical connection portion is electrically connected to the circuit.

In a preferred embodiment, the susceptor portion defines thereon at least one gap along a length direction.

The embodiment of the present disclosure further provides a susceptor for an aerosol generation device, wherein the susceptor is configured to be penetrated by a varying magnetic field so as to generate heat, thereby heating a smokable material, wherein on the susceptor is formed a conductive track in heat-conducting connection with the susceptor; and the conductive track has a positive or negative temperature coefficient of resistance, so that the temperature of the susceptor can be determined by measuring a resistance value of the conductive track and on the basis of the resistance value.

In a preferred embodiment, the susceptor includes:

an electrically insulating substrate, and a susceptor material layer formed on the electrically insulating substrate; wherein the susceptor material layer is configured to be penetrated by a varying magnetic field so as to generate heat.

The embodiment of the present disclosure further provides a susceptor for an aerosol generation device, wherein the susceptor is configured to be penetrated by a varying magnetic field so as to generate heat, thereby heating a smokable material, wherein the susceptor further includes:

a susceptor portion, which is configured to be penetrated by a varying magnetic field so as to generate heat, thereby heating a smokable material; and an electrical connection portion arranged on the susceptor portion, through which a direct-current detection voltage can be provided to the susceptor, so as to measure a resistance value of the susceptor under the direct-current detection voltage and to determine the temperature of the susceptor on the basis of the resistance value.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form restrictions unless otherwise stated.

DETAILED DESCRIPTION

For a better understanding, the present disclosure is described below in further detail in conjunction with accompanying drawings and specific embodiments.

Figure 1:
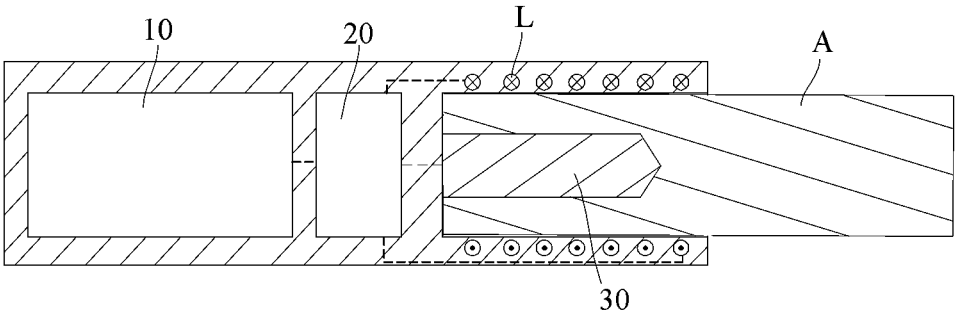
FIG. 1 is a diagram of an aerosol generation device according to one embodiment.

One embodiment of the present disclosure provides an aerosol generation device, whose structure can refer to FIG. 1, including:

- a chamber, in which a smokable material A is removably received;
- an induction coil L, which is configured to generate a varying magnetic field under an alternating current;
- a susceptor 30, which extends at least in part in the chamber and is configured to be inductively coupled with the induction coil L and to generate heat while being penetrated by the varying magnetic field, thereby heating the smokable material A such as cigarette, so that at least one composition of the smokable material A vaporizes to form an aerosol for inhalation;
- a battery cell 10, which is a rechargeable Direct Current (DC) battery cell and can output DC; and
- a circuit 20, which is electrically connected to the rechargeable battery cell 10 and converts the DC output from the battery cell 10 into an Alternating Current (AC) with an appropriate frequency and then supplies it to the induction coil L.

The circuit 20 is configured to determine the temperature of the susceptor 30 by acquiring a resistance value of at least some of the material on the susceptor 30 and on the basis of the resistance value.

According to the usage setting of products, the induction coil L may include a cylindrical inductor coil wound in a spiral shape, as shown in FIG. 1. The cylindrical induction coil L wound in a spiral shape may have a radius ranged from about 5 mm to about 10 mm, in particular, the radius r may be about 7 mm. The cylindrical induction coil L wound in a spiral shape may have a length ranged from about 8 mm to about 14 mm, and the induction coil L has a number of windings ranged from about 8 windings to 15 windings. Correspondingly, the internal volume may be ranged from about 0.15 $cm^3$ to about 1.10 $cm^3$.

In a more preferred embodiment, the frequency of the alternating current supplied by the circuit 20 to the induction coil L is between 80 KHz and 400 KHz; more specifically, the frequency may be ranged from about 200 KHz to 300 KHz.

In a more preferred embodiment, the frequency of the alternating current supplied by the circuit 20 to the induction coil L is between 80 KHz and 400 KHz; more specifically, the frequency may be ranged from about 200 KHz to 300 KHz.

In a preferred embodiment, the DC supply voltage supplied by the battery cell 10 is ranged from about 2.5 V to about 9.0 V, and the amperage of the DC supplied by the battery cell 10 is ranged from about 2.5 A to about 20 A.

According to the preferred embodiment shown in FIG. 1, the induction coil L is a spiral coil wound around the chamber and extending along an axial direction of the chamber.

Figure 2:
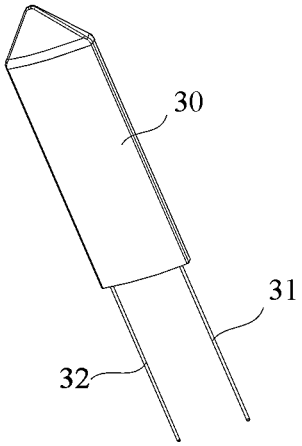
FIG. 2 is a diagram of one embodiment of a susceptor shown in FIG. 1.

In the preferred embodiments shown in FIG. 1 and FIG. 2, the susceptor 30 presents a sheet shape extending along the axial direction of the chamber, may have a length of about 12 mm, a width of about 4 mm and a thickness of about 50 μm, and can be made of Grade 430 stainless steel (SS430). As an alternative embodiment, the susceptor 30 may have a length of about 12 mm, a width of about 5 mm and a thickness of about 50 μm, and can be made of Grade 430 stainless steel (SS430). In corresponding variations, the susceptor 30 can also present a pin or needle like structure.

Figure 3:
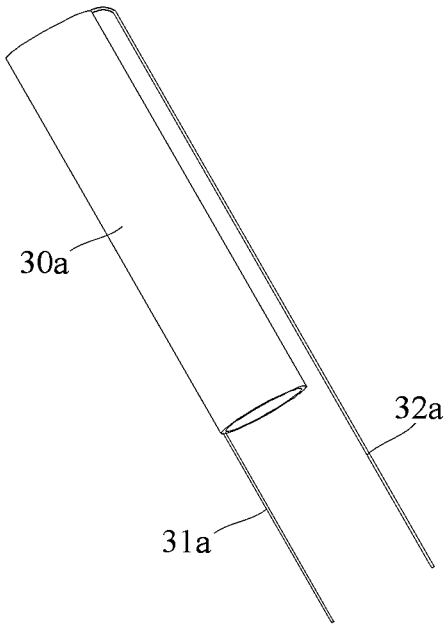
FIG. 3 is a diagram of a susceptor according to another embodiment.

Or, in another preferred embodiment, the susceptor 30*a* can also be constructed as a cylindrical shape, as shown in FIG. 3. During usage, the inner space is used for receiving the smokable material A and heating the periphery of the smokable material A to generate an aerosol for inhalation. These susceptors can also be made of Grade 420 stainless steel (SS420) and alloy materials containing iron and nickel (for example, permalloy).

Further, referring to the preferred embodiment shown in FIG. 2, two ends of the susceptor 30 are provided with a conductive pin respectively, for inserting the susceptor 30 into the circuit 20; specifically, the pin includes a first pin 31 and a second pin 32. During implementation, due to the above materials excellent in magnetoconductivity employed by the susceptor 30, the prepared susceptor 30 has a positive temperature coefficient of resistance; therefore, during usage, when the susceptor 30 is connected to the circuit 20, by providing a detection signal to the susceptor 30, the effective resistance of the susceptor 30 can be calculated, and then the temperature of the susceptor 30 can be determined.

The susceptor further includes a base portion, and the aerosol generation device provides supporting for the susceptor through the base portion.

Figure 4:
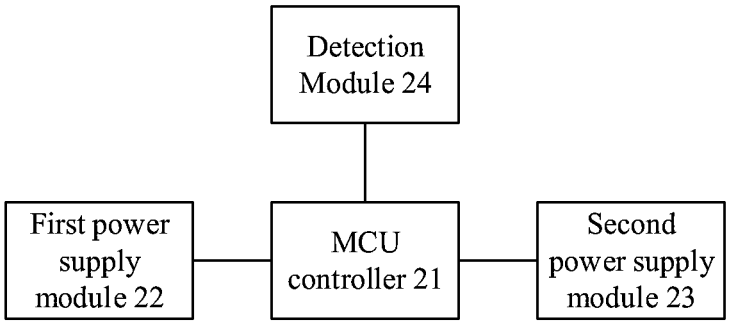
FIG. 4 is a block diagram of modules of a circuit according to one embodiment.
Figure 5:
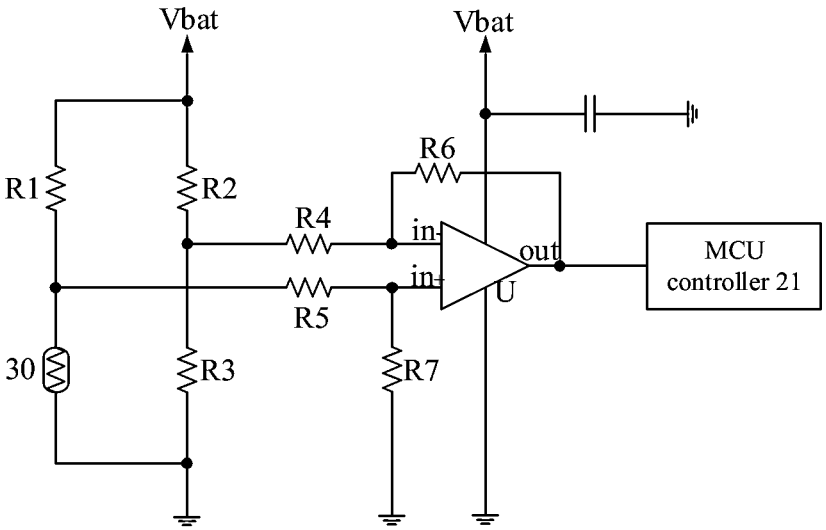
FIG. 5 is a diagram of a second power supply module and a detection module of the circuit shown in FIG. 4.

Specifically, in order to realize the detection of effective resistance of the above susceptor 30, the structure of the circuit 20 can refer to FIG. 4 to FIG. 5 in one embodiment, including:

- an MCU controller 21, which controls the operation of each function module as a controller;
- a first power supply module 22, which, in embodiments, can be implemented by employing commonly used DC/AC inverters or LC oscillators, and converts the DC of the battery cell 10 into AC to provide to the induction coil L, so that the induction coil L generates a varying magnetic field;
- a second power supply module 23, which is configured to provide a DC detection voltage to the susceptor 30; and
- a detection module 24, which is configured to detect a resistance value of the susceptor 30 under the DC detection voltage and determine the temperature of susceptor 30 on the basis of the resistance value.

Specifically, one embodiment of the second power supply module 23 and the detection module 24 can refer to FIG. 5. The second power supply module 23 forms a voltage division circuit through a standard voltage division resistor R1 in series connection with the susceptor 30, and is connected to the voltage output terminal of the battery cell 10 and grounded respectively, so as to provide an appropriate detection voltage to the susceptor 30.

Further, the detection module 24 acquires the voltage of the susceptor 30 through a sampling end in+ of an operational amplifier U, and compares it with a reference voltage of a reference end in− to calculate the voltage of the susceptor 30. Then, the calculated result is fed back to the MCU controller 21, which then calculates the effective resistance of the susceptor 30 according to a proportional relationship of the standard voltage division resistor R1. And then the actual temperature of the susceptor 30 can be determined according to the temperature coefficient of resistance.

In one variant embodiment, the reference end in– of the operational amplifier U shown in FIG. 4 can be changed to being directly grounded from being supplied by the output terminal of the battery cell 20, and then the grounding voltage is taken as the reference voltage for comparison calculation.

Figure 6:
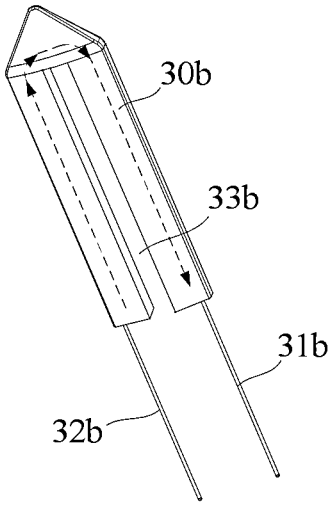
FIG. 6 is a diagram of a susceptor according to another embodiment.

Further, in a more preferred embodiment, in order to improve the detectable resistance value of the susceptor 30, referring to FIG. 6, a blade like susceptor 30*b* defines thereon at least one gap 33*b* extending along the length direction. During the process of detection, when the susceptor 30*b* is detected through the first pin 31*b* and the second pin 32*b*, the current flow passing through the susceptor 30*b* is as shown by the arrow in FIG. 6. Through the arrangement of the gap 33*b*, the cross-sectional area of current flow is reduced and the path of current flow is increased for the susceptor 30*b*, thus improving the detected resistance of the susceptor 30. Meanwhile, from FIG. 6, in order not to prevent an upper end of the blade like susceptor 30*b* being smoothly inserted into the smokable material A to heat, the first pin 31*b* and the second pin 32*b* are both connected to the susceptor 30*b* through a lower end of the susceptor 30*b* shown in FIG. 5.

Figure 7:
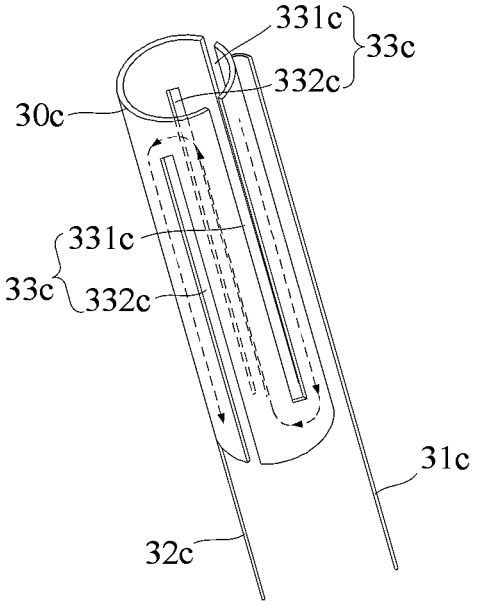
FIG. 7 is a diagram of a susceptor according to another embodiment.

Or, in a preferred embodiment shown in FIG. 7, a tubular susceptor 30*c* also defines thereon at least one gap 33*c* extending along the axial direction; furthermore, the above gap 33*c* is used for guiding the path of current flow during the process of detection, so that the susceptor 30*c* may have a higher detectable resistance value when its temperature is measured through the first pin 31*c* and the second pin 32*c*, thereby improving the accuracy of the result of temperature detection. Moreover, from FIG. 7, in order to increase the detected resistance value of the tubular susceptor 30*c*, the first pin 31*c* and the second pin 32*c* are connected to the susceptor 30*c* at two ends of the axial direction of the susceptor 30*c* respectively.

Of course, further, from FIG. 7, when there are multiple gaps 33*c*, they are arranged in different modes. Specifically, a first gap 331*c* extends from the upper end of the susceptor 30*c* along the length direction, and a second gap 332*c* extends from the lower end of the susceptor 30*c* along the length direction, so that they have different opening directions. Moreover, when there are multiple gaps 33*c*, the first gap 331*c* and the second gap 332*c* are alternately arranged along the circumferential direction of the susceptor 30*c*, so that, during the process of detection, the current flow passing through the susceptor 30*c* has a circuitous path as shown in FIG. 7, thereby improving the detected resistance value.

Figure 8:
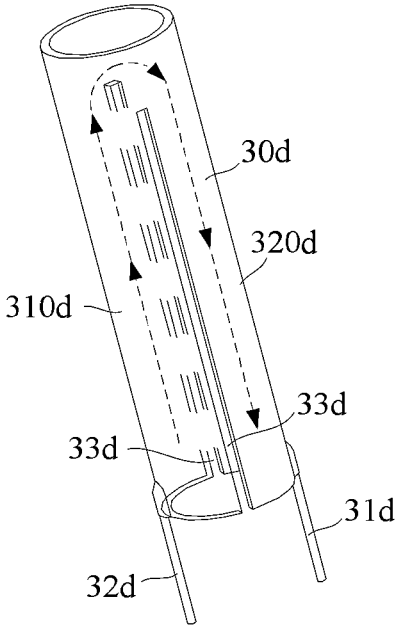
FIG. 8 is a diagram of a susceptor according to another embodiment.

Or, in another variant embodiment, referring to FIG. 8, a susceptor 30*d* presents a tubular shape, at least part of an inner surface of the susceptor 30*d* forms the chamber, and the susceptor 30*d* includes two same gaps 33*d* extending from the lower end towards the upper end, which thus separate the susceptor 30*d* into two portions that are located between the two gaps 33*d* along the circumferential direction, that is, a left half portion 310*d* and a right half portion 320*d* shown in FIG. 7. Meanwhile, the first pin 31*d* and the second pin 32*d* are connected to the left half portion 310*d* and the right half portion 320*d* at or near the lower end, respectively, thereby forming the circuitous path of current flow shown by the arrow in FIG. 7.

In another preferred embodiment, the above first pin 31/31*a*/31*b*/31*c* and second pin 32/32*a*/32*b*/32*c* are made of materials having a temperature coefficient of resistance, for example, commonly used thermocouple wires, including nickel iron copper alloy, nickel chromium aluminum alloy, nickel chromium copper alloy, platinum, tungsten, etc. Then, during the process of detection, it is the combined resistance value of the susceptor and the first pin 31/31*a*/31*b*/31*c* and second pin 32/32*a*/32*b*/32*c* that is detected; therefore, by amplifying the resistance of the susceptor 30/30*a*/30*b*/30*c* during the process of detection, the resistance value and the result of temperature detection can be improved. During implementation, since the resistance of the susceptor 30/30*a*/30*b*/30*c* is amplified employing the first pin 31/31*a*/31*b*/31*c* and the second pin 32/32*a*/32*b*/32*c* having a temperature coefficient of resistance, it is required that the first pin 31/31*a*/31*b*/31*c* and the second pin 32/32*a*/32*b*/32*c* have the same type of temperature coefficient of resistance; for example, if the employed susceptor 30/30*a*/30*b*/30*c* having the above ferromagnetic materials has a positive temperature coefficient of resistance, namely, the resistance value increases while the temperature rises, the first pin 31/31*a*/31*b*/31*c* or the second pin 32/32*a*/32*b*/32*c* is also required to have a positive temperature coefficient of resistance.

In a more preferred embodiment, in order to avoid a temperature difference between the first pin 31/31*a*/31*b*/31*c* and the second pin 32/32*a*/32*b*/32*c* and the susceptor in preparation the first pin 31/31*a*/31*b*/31*c* and the second pin 32/32*a*/32*b*/32*c* are welded with the susceptor 30/30*a*/30*b*/30*c* through a technique of ultrasonic butt-joint, to eliminate difference as far as possible.

Figure 9:
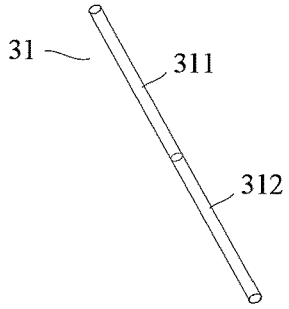
FIG. 9 is a diagram of a first conductive pin according to another embodiment.

Or, in a more preferred embodiment, the above first pin 31 includes two sections of materials. Specifically, referring to FIG. 9, the first pin 31 includes a first section 311 and a second section 312 that are arranged in sequence along the length direction; wherein the first section 311 is made of a material having a higher temperature coefficient of resistance, for example, the above commonly used thermocouple wires, including nickel iron copper alloy, nickel chromium aluminum alloy, nickel chromium copper alloy, platinum, tungsten, etc., aiming to amplify the resistance of the susceptor 30/30*a*/30*b*/30*c* during the process of detection and to improve the resistance value and the result of temperature detection. The second section 312 is made of a material having a lower temperature coefficient of resistance, aiming to make the second section 312 have a lower temperature than the first section 311 during usage, thereby preventing thermal damages of high temperature to the subsequent welding of circuit 20 and the like. Further, the second section 312 is also required to have high conductivity and weldability, for good welding with the circuit 20, and appropriate materials are gold, silver, copper, etc.

Figure 10:
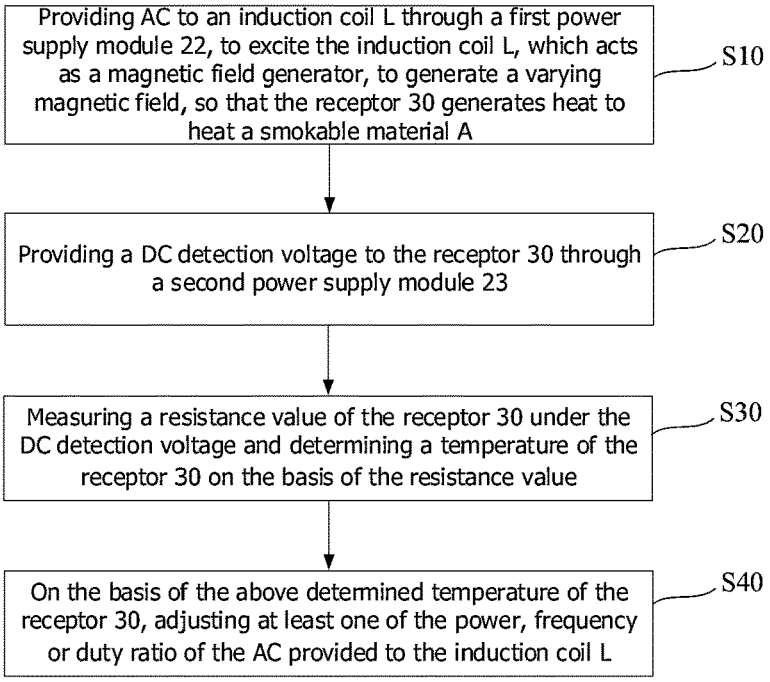
FIG. 10 is a diagram of a method for detecting a temperature of a susceptor according to one embodiment.

An embodiment of the present disclosure further provides a method for controlling an aerosol generation device having the above susceptor 30/30*a*/30*b*/30*c*/30*d* to generate an aerosol, which, referring to FIG. 10, includes the following steps:

- S10: providing AC to an induction coil L through a first power supply module 22, to excite the induction coil L, which acts as a magnetic field generator, to generate a varying magnetic field, so that the susceptor 30 generates heat to heat a smokable material A.
- S20: providing a DC detection voltage to the susceptor 30 through a second power supply module 23.
- S30: measuring a resistance value of the susceptor 30 under the DC detection voltage and determining a temperature of the susceptor 30 on the basis of the resistance value.
- S40: on the basis of the above determined temperature of the susceptor 30, adjusting at least one of the power, frequency or duty ratio of the AC provided to the induction coil L, thereby regulating the generated varying magnetic field, so that the susceptor 30 can be maintained at a predetermined target temperature.

Figure 11:
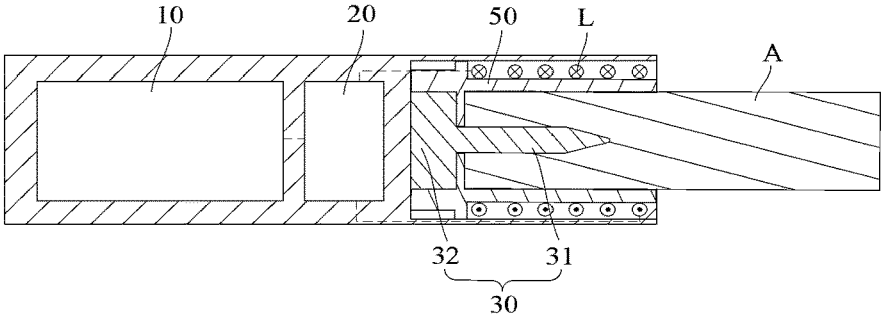
FIG. 11 is a structure diagram of an aerosol generation device according to another embodiment.
Figure 12:
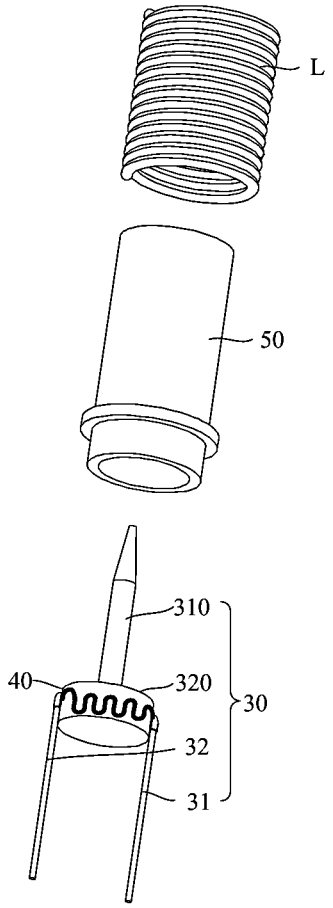
FIG. 12 is an exploded diagram of an induction coil, a tubular support and a susceptor shown in FIG. 11 before assembly.

In the embodiment shown in FIG. 11, different from the above embodiments, the aerosol generation device further includes a tubular support 50 for arranging the induction coil L and the susceptor 30; as shown in FIG. 11 to FIG. 12, the material of the tubular support 50 may include high-temperature resistant non-metallic materials, such as PEEK or ceramic. During implementation, the induction coil L is arranged on the outer wall of the tubular support 50 in a winding manner.

Figure 13:
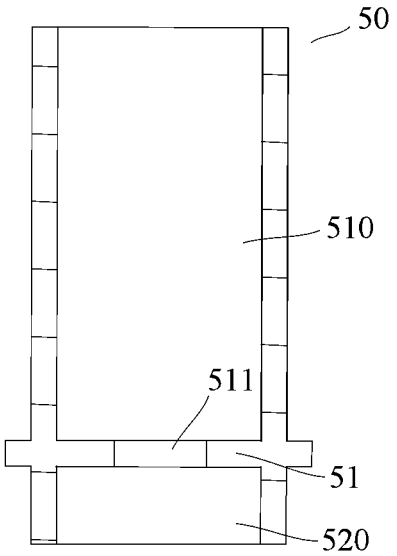
FIG. 13 is a sectional view of the tubular support shown in FIG. 12.

In order for improving the flexibility of easy fixing and installation, replacement and cleaning of the susceptor 30, referring to FIG. 12 and FIG. 13, the tubular support 50 is internally provided with a partition portion 51 which extends along a radial direction and whose internal diameter is less than that of the tubular support 50. Through the partition portion 51, the inner space of the tubular support 50 is divided into upper and lower parts, namely, a first accommodation portion 510 and a second accommodation portion 520 respectively. According to such a structure, the first accommodation portion 510 is configured as the above chamber for accommodating the smokable material A; meanwhile, when the smokable material A is accommodated in the first accommodation portion 510, a front end of the smokable material A abuts against the partition portion 51 so as to be supported and held, thus enabling a stop of the smokable material A.

The structure of the susceptor 30 is adjusted correspondingly. The susceptor 30 includes a susceptor portion, which is configured to be penetrated by the varying magnetic field so as to generate heat, thereby heating the at least some of the smokable material received in the chamber. The susceptor portion includes a pin or blade like heating portion 310, which extends in the first accommodation portion 510 along the axial direction. When the smokable material A is accommodated in the first accommodation portion 510, the heating portion 310 can be inserted into the smokable material A to heat the interior of the smokable material A; meanwhile, the susceptor 30 further includes a base portion 320 accommodated in the second accommodation portion 520; the outline of the base portion 320 fits the second accommodation portion 520 to enable tight contact. Of course, the base portion 320, which can be easily held in the second accommodation portion 520, is arranged to facilitate the installation and fixing of the susceptor 30. Meanwhile, according to such implementation, the partition portion 5 includes a perforation 511 for the heating portion 310 to pass through, such that one end of the heating portion 310 is connected to the base portion 320 and the other end extends into the first accommodation portion 510.

In one preferred embodiment, in order to be able to correctly monitor the temperature of the susceptor 30 and to control the susceptor 30 to be within a proper heating temperature range, referring to FIG. 11, the aerosol generation device further includes a conductive track 40 having a positive or negative temperature coefficient of resistance; during implementation, the conductive track 40 is arranged to be in heat-conducting contact with the susceptor portion of the susceptor 30, and is coupled to the circuit 20; and then the circuit 20 can determine the temperature of the susceptor 30 by measuring the resistance of the conductive track 40.

Figure 15:
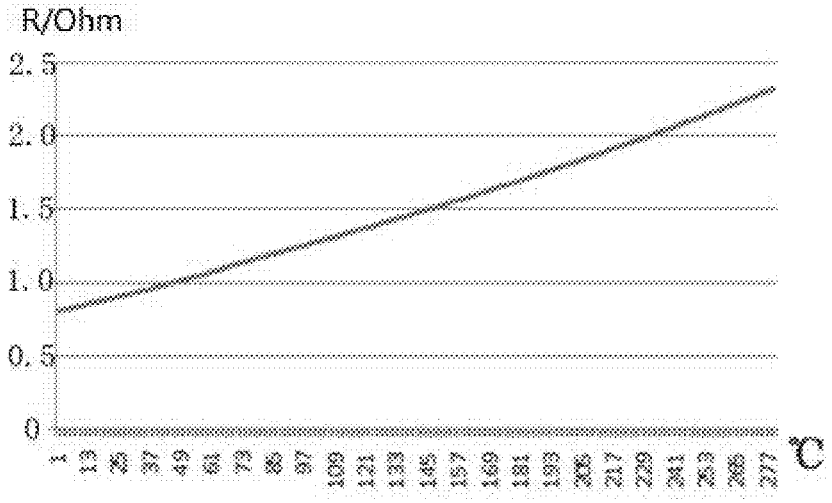
FIG. 15 is a curve of a resistance of a conductive track changing with temperature according to one embodiment.

The above conductive track 40 preferably may be formed by a metal which includes appropriate inherent material properties that are used for providing a linear approximation of the resistance as a function of temperature. In the embodiment, examples of appropriate metals include Pt, Ti, Cu, Ni or various alloys containing them. In other variant embodiments, the conductive track 40 can also be formed by any other metals which have a relatively large temperature coefficient of resistance ($\alpha$) that will have no obvious fluctuation as a function of temperature. FIG. 15 is a diagram of a curve of the change of a resistance of a conductive track 40, having a positive temperature coefficient of resistance and prepared by screen printing of a platinum nickel chromium alloy, with temperature according to one embodiment.

In the preferred embodiment shown in FIG. 12, the conductive track 40 is bounded onto the susceptor 30 to form heat conduction, through printing, etching, deposition, electroplating and the like modes. When the susceptor 30 is induced to generate heat, the heat can be directly transferred from the inductor 30 to the conductive track 40, so that the temperatures of they two are or near the same. In consequence of the change of temperature, the resistance of the conductive track 40 changes too, and then by measuring the resistance of the conductive track 40, the temperature of the susceptor 30 can be acquired.

In order to avoid the abrasion to the conductive track 40 caused by the smokable material A being bounded onto or removed from the heating portion 310, in the embodiment shown in FIG. 2, the conductive track 40 is bounded onto the base portion 320. Alternatively, in other variant embodiments, the conductive track 40 is bounded onto at least part of the surface of the pin or blade like heating portion 310 through printing, etching deposition, electroplating and the like modes.

Further, in more preferred embodiments, a protection film can be formed on the exposed outer surface of the conductive track 40 through spraying, sputtering, deposition and the like modes. The protection film may employ materials such as glass, ceramic and glaze, with the thickness controlled between 1 and 50 μm. Such a protection film is to prevent the damages to the conductive track 40 caused by collision, scratch and the like during the preparation and assembly process.

In the preferred embodiment shown in FIG. 12, the conductive track 40 has two ends provided with an electrical connection part. The electrical connection part can be easily connected to the circuit 20 by being welded on the conductive pins at two ends of the susceptor 30.

In another embodiment, the conductive track 40 is insulated from the susceptor 30, then the susceptor 30 prepared by metals or alloys does not affect the measurement of resistance of the conductive track 40. During implementation, the surface of the susceptor 30 or at least the surface contacting the conductive track 40 can be formed with an insulating layer, such as glaze and oxide, through oxidation, coating and the like modes, so as to be insulated from the conductive track 40.

Figure 14:
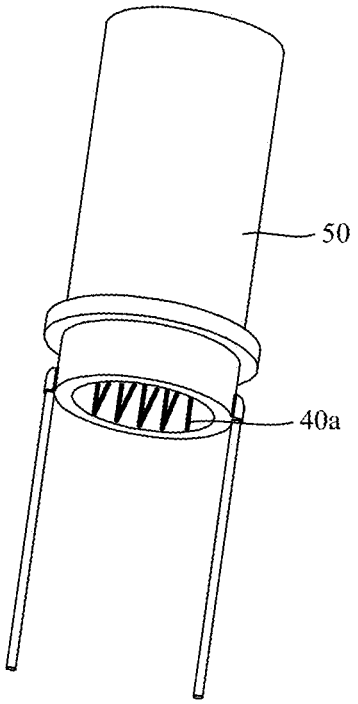
FIG. 14 is a structure diagram of a tubular support according to another embodiment.

Or, in another variant embodiment shown in FIG. 14, a conductive track 40*a* is formed on an inner wall of the second accommodation portion 520, thereby being in heat-conducting contact with the base portion 320 accommodated in the second accommodation portion 520. Meanwhile, two ends of the conductive track 40*a* are welded on the conductive pin, so that the conductive track 40*a* can be connected to the circuit 20. Therefore, the temperature of the susceptor 30 can be calculated by measuring the resistance of the conductive track 40*a*. In the present embodiment, the conductive track 40*a* and the tubular support 50 are prepared as one piece, which then is installed with the susceptor 30 to form an assembly module, enabling quick production and preparation and accurate measurement of temperature.

Figure 16:
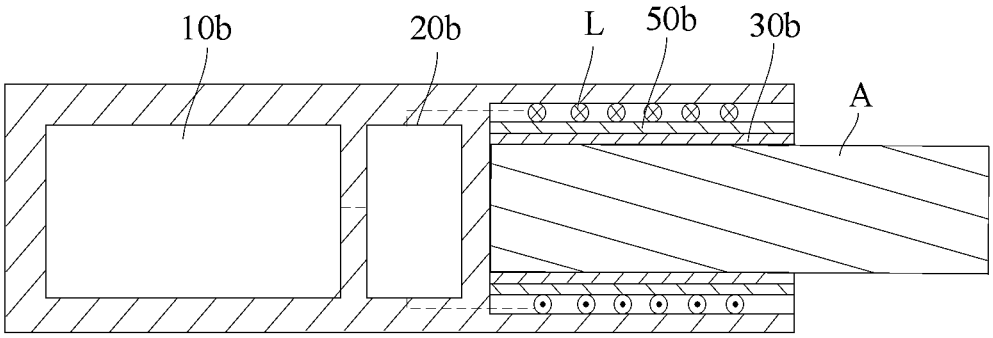
FIG. 16 is a structure diagram of an aerosol generation device according to another embodiment.

In another embodiment shown in FIG. 16, a tubular susceptor 30*b* is coaxially arranged in the hollow of the tubular support 50*b* and is inductively coupled with the induction coil L. The inner space of the tubular susceptor 30*b* forms a chamber for accommodating the smokable material A. Meanwhile, in order for detecting the temperature of the tubular susceptor 30*b*, the conductive track 40*b* is formed on the outer surface of the tubular susceptor 30*b* through printing, etching, deposition, electroplating and the like modes, as shown in FIG. 15. Alternatively, in other variations, the conductive track 40*b* can also be formed on the inner wall of the tubular support 50*b*; when the tubular susceptor 30*d* is arranged in the tubular support 50*d*, the tubular susceptor 30*d* can be in heat-conducting contact with the conductive track 40*d*, thereby realizing the purpose of temperature monitoring.

In a more preferred embodiment, when the conductive track 40*a*/40*b* is formed on the inner wall of the tubular support 50 through the above modes, in order to guarantee that the conductive track 40*a*/40*b* can be in stable and tight heat-conducting contact with the susceptor 30/30*b*, the inner wall surface of the tubular support 50 first can be formed with an elastic medium layer, for example containing elastic materials having flexibility such as resin and silica gel, or containing insulating flexible carrier materials such as polyimide film (PI film), and then the conductive track 40*a*/40*b* is formed on the inner wall of the tubular support 50. The flexible force of the elastic layer enables the conductive track 40*a*/40*b* to be in tight contact with the outer surface of the tubular susceptor 30*b*, thereby preventing rigid contact leading to existence of gaps and thus causing instable heat conduction effect.

An embodiment of the present disclosure further provides a method for monitoring a temperature of an aerosol generation device employing electromagnetic induction heating. An example of the aerosol generation device can refer to what is shown in FIG. 11. The aerosol generation device includes: a chamber, in which a smokable material A is removably received;

- an induction coil L, which is configured to generate a varying magnetic field under an alternating current;
- a susceptor 30, which extends at least in part in the chamber and is configured to be inductively coupled with the induction coil L and to generate heat while being penetrated by the varying magnetic field, thereby heating the smokable material A such as cigarette, so that at least one composition of the smokable material A vaporizes to form an aerosol for inhalation;
- a battery cell 10, which is a rechargeable Direct Current (DC) battery cell and can output DC; and
- a circuit 20, which is electrically connected to the rechargeable battery cell 10 and converts the DC output from the battery cell 10 into an Alternating Current (AC) with an appropriate frequency and then supplies it to the induction coil L.

Figure 18:
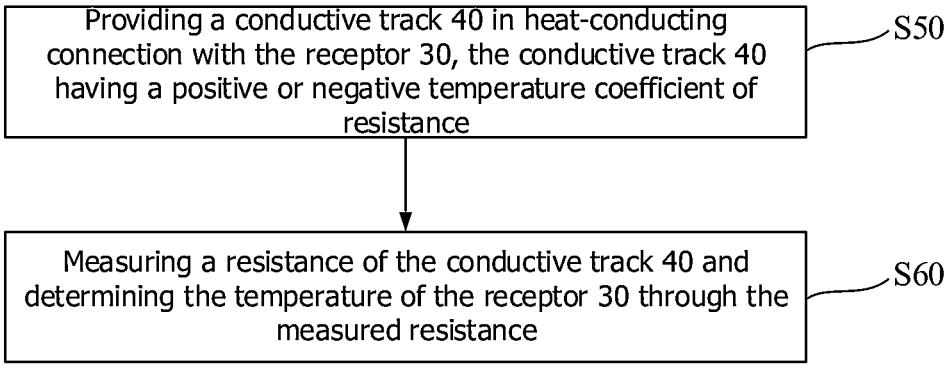
FIG. 18 is a temperature monitoring method for an aerosol generation device according to one embodiment.

Referring to FIG. 18, the temperature monitoring method includes the following steps:

- S50: providing a conductive track 40 in heat-conducting connection with the susceptor 30, the conductive track 40 having a positive or negative temperature coefficient of resistance.
- S60: measuring a resistance of the conductive track 40 and determining the temperature of the susceptor 30 through the measured resistance.

Figure 17:
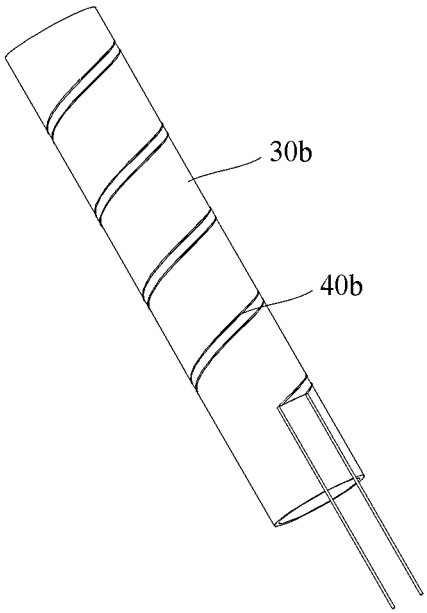
FIG. 17 is a diagram of a susceptor shown in FIG. 16.

An embodiment of the present disclosure further provides a susceptor 30*b* for an aerosol generation device employing electromagnetic induction heating, as shown in FIG. 17. The susceptor can be penetrated by a varying magnetic field so as to generate heat. A conductive track 40*b*, in heat-conducting connection with and insulated from the susceptor 30*b*, is formed on the susceptor 30*b*. The conductive track 40*b* has a positive or negative temperature coefficient of resistance, so that the temperature of the susceptor can be determined by detecting the resistance value of the conductive track 40*b*.

In one preferred embodiment, in order to be able to correctly monitor the temperature of the susceptor 30 and to control a lower heat loss caused by a member in contact with the susceptor during installation, the structure of the susceptor 30 can refer to FIG. 16 in detail. The heating portion 310 includes:

an electrically insulating substrate 3101, which is constructed as a pin or blade like shape capable of being inserted into a smokable material A, as shown in FIG. 16. During implementation, the electrically insulating substrate 3101 may be integrally prepared with the base portion 320, employing materials such as alumina and zirconia ceramic, or rigid high-temperature resistant polymer resins, or metal matrixes processed through insulation, and so on.

A susceptor material layer 3102 bounded onto the outside of the electrically insulating substrate 3101 through deposition or spraying or winding or wrapping and the like modes. In an optional embodiment, the susceptor material layer 3102 is a coating formed on the electrically insulating substrate 3101 through PVD deposition or plasma spraying and the like modes. The susceptor material layer 3102 may employ induction heating metals or alloy materials having appropriate magnetoconductivity, so that it can be induced to generate heat by the magnetic field generated by the induction coil L. During implementation, the susceptor material layer 3102 preferably has a thickness less than 0.2 mm or even thinner, for example, when materials excellent in magnetoconductivity, such as permalloy, are employed, the skin effect can be met as long as the thickness is greater than 2.8 μm.

Further, in a preferred embodiment, the extending length of the susceptor material layer 3102 on the electrically insulating substrate 3101 is covered by the length of the induction coil L which acts as a magnetic field generator, namely, the susceptor material layer 3102 is basically completely located within the induction coil L. Moreover, the length of the susceptor material layer 3102 can completely cover the conductive track 40, enabling a higher uniformity.

Further, the conductive track 40 in heat-conducting connection with the susceptor material layer 3102 is coupled with the circuit 20 through the conductive pins. Specifically, the electrical connection parts at two ends of the electric-conduction connection portion are coupled with the circuit 20 through the conductive pins, thus during usage, the circuit 20 can calculate and acquire the resistance of the conductive track 40 by sampling the voltage and current at two ends of the conductive track 40. In the heating portion 310 of the above structure, when the susceptor material layer 3102 is induced to generate heat, the heat can be directly transferred from the susceptor material layer 3102 to the conductive track 40, so that the temperatures of the two are or near the same. In consequence of the change of temperature, the resistance of the conductive track 40 changes too, and then by measuring the resistance of the conductive track 40, the temperature of the susceptor material layer 3102 can be acquired.

Figure 19:
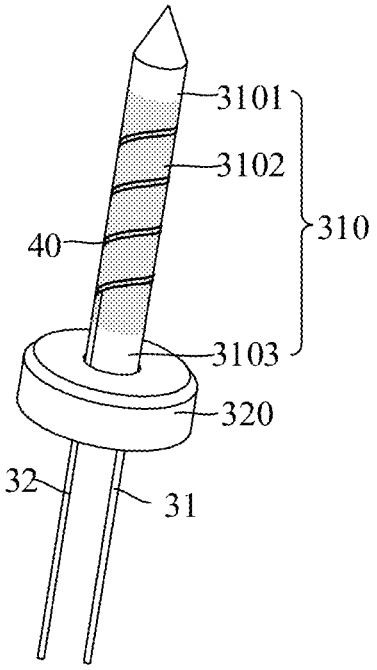
FIG. 19 is a structure diagram of a susceptor shown in FIG. 16 according to another embodiment.

For example, in the preferred embodiment shown in FIG. 19, the conductive track 40 is constructed as a spiral shape wound around the electrically insulating substrate 3101 and/or the susceptor material layer 3102 and extending along the axial direction of the electrically insulating substrate 3101 and/or the susceptor material layer 3102.

Of course, in the above embodiments, the conductive track 40 and the susceptor material layer 3102 are insulated from each other, preventing the occurrence of interference while the circuit 20 measures the resistance of the conductive track 40. Specifically, an insulating layer (not shown in figures) can be arranged between the conductive track 40 and the susceptor material layer 3102, for example, during the preparation, a thin insulating protection layer such as glass/glaze is first deposited or sprayed on the surface of the susceptor material layer 3102, and then the above conductive track 40 is formed on it.

In yet another variable preferred embodiment, the conductive track 40 is formed between the electrically insulating substrate 3101 and the susceptor material layer 3102; that is to say, the susceptor material layer 3102 is located outside the conductive track 40 relatively. During usage, by making the susceptor material layer 3102 located outside the conductive track 313, the internal area of the susceptor material layer 3102 along the axial direction is almost a magnetically shielded area, and the conductive track 40 itself, located in the magnetically shielded area, will not be induced by the alternating magnetic field to generate current, thereby avoiding interfering with the measurement of resistance.

Further, in order for preventing abrasion to the susceptor 30 during usage, a protection film can be formed on the outermost surface of the heating portion 310 through spraying, sputtering, deposition and the like modes. The protection film may employ materials such as glass, ceramic and glaze, with the thickness controlled between 1 and 50 μm.

In another optional embodiment, the susceptor material layer 3102 is applied onto the outer surface of the electrically insulating substrate 3101, as a metal foil.

Further, according to the preferred embodiment shown in FIG. 19, the susceptor material layer 3102 is spaced from the base portion 320 along the axial direction of the susceptor 30 to form a reserved area 3103. During usage, the partition portion 51 of the support 50 is held or connected on the reserved area 3103 part, and after assembly, the susceptor material layer 3102 and the partition portion 51 of the support 50 are spaced from each other and do not contact each other, thus avoiding the heat of the susceptor material layer 3102 being transferred to the partition portion 51 of the support 50 through a contact manner.

The above conductive track 40 can be formed on the flat surface of a sheet like ceramic green body by printing, deposition and the like modes, as shown in FIG. 17. In order to conveniently weld the conductive track 40 onto the conductive pin, two ends of the conductive track 40 are provided with an electrical connection portion 41 having a low resistance coefficient, and the electrical connection portion 41 may employ materials of low resistance coefficient such as silver, gold, silver palladium alloy, etc.

The above susceptor material layer 3102 can also be formed by the method shown in FIG. 18, specifically, a hollow metal tube 3102*a* is heated, of which the inner diameter is slightly less than the outer diameter of the electrically insulating substrate 3101, and when heated to the highest operating temperature (for example, greater than 350° C.) of the product, the thermally expanded metal tube 3102*a* is sleeved on the surface of the electrically insulating substrate 3101 that has a conductive track 40; after being cooled, the hollow metal tube 3102*a* is fastened onto the surface of the electrically insulating substrate 3101, thereby forming a susceptor material layer 3102 in tight heat-conducting contact with the conductive track 40.

Or, in other variable embodiments, the above hollow metal tube 3102*a* can also be replaced by a hollow needle or pin like structure.

Figure 20:
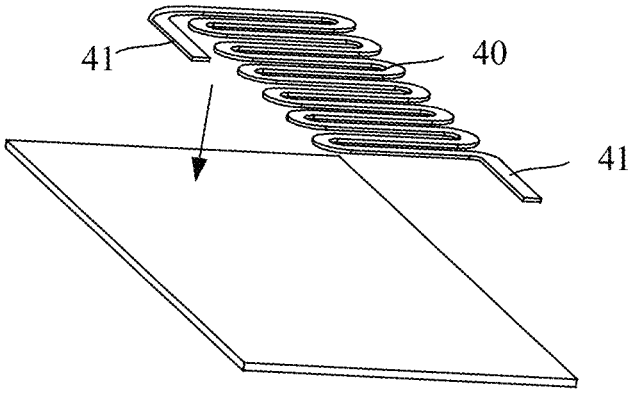
FIG. 20 is a diagram of forming a conductive track on a ceramic green body.
Figure 21:
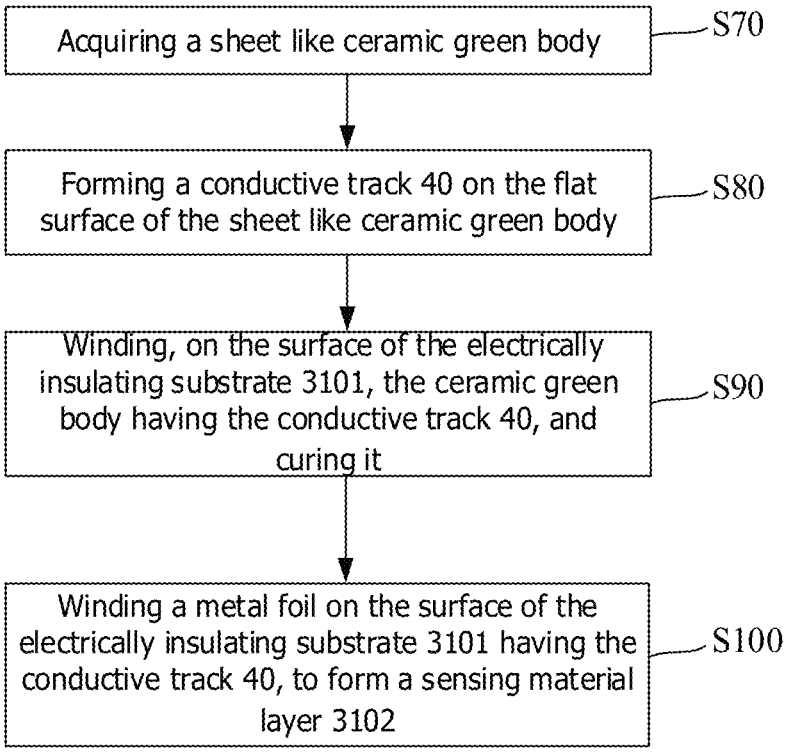
FIG. 21 is a diagram of steps of a method for preparing a susceptor according to one embodiment.

Yet another embodiment of the present disclosure further provides a method for preparing a susceptor 30 of an aerosol generation device, specifically including the following steps, referring to FIG. 19 to FIG. 21.

S70: acquiring a sheet like ceramic green body, which can be a directly purchased ceramic paper such as flexible alumina or zirconia.

S80: as shown in FIG. 20, forming a conductive track 40 on the flat surface of the sheet like ceramic green body through printing, deposition and the like modes. Of course, in order to conveniently weld the conductive track 40 onto the conductive pin in following processes, two ends of the conductive track 40 are provided with an electrical connection portion 41 having a low resistance coefficient, and the electrical connection portion 41 may employ materials of low resistance coefficient such as silver, gold, silver palladium alloy, etc.

In an optional embodiment, the conductive track 40 formed by printing has a thickness of about 10 to 30 μm.

Figure 22:
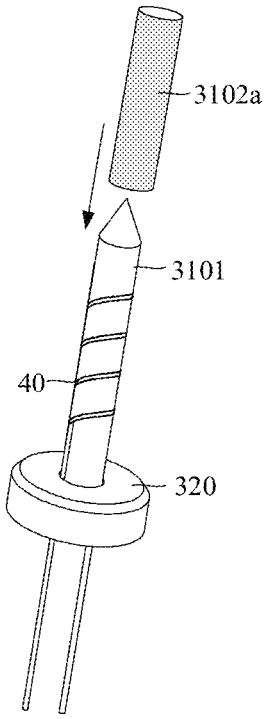
FIG. 22 is a diagram of sleeving a hollow metal tube on an electrically insulating substrate to form a susceptor.

S90: acquiring a pin like electrically insulating substrate 3101 made of ceramic, as shown in FIG. 19, then winding, on the surface of the pin like electrically insulating substrate 3101, the sheet like ceramic green body formed in S80 having the conductive track 40, and next forming into one piece by isostatic pressing or sintering curing, to form the electrically insulating substrate 3101 having the conductive track 40 as shown in FIG. 22. Based on the implementation situation, two ends of the electrical connection portion 41 can be welded with a conductive pin.

S100: acquiring a metal foil used for forming the susceptor material layer 3102, winding it on the surface of the electrically insulating substrate 3101 cured in S90 having the conductive track 40, and then welding together the seam of the metal foil formed after winding. During the welding process, the metal foil is firmly bounded onto the surface of the electrically insulating substrate 3101, to form a tubular susceptor material layer 3102. After this process, a protection film and the like can be sprayed on the surface. Finally, the susceptor 30 for the aerosol generation device is acquired.

Figure 23:
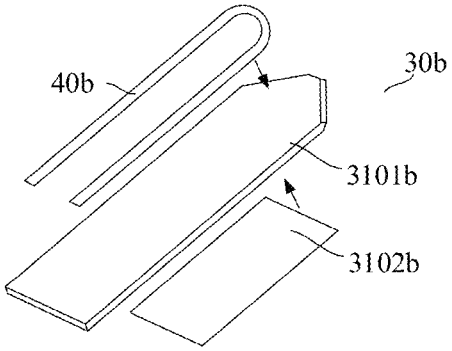
FIG. 23 is a structure diagram of a susceptor according to another embodiment.

Or, in yet another variable embodiment, referring to FIG. 23, the susceptor 30*b* includes a blade like electrically insulating substrate 3101*b*; the electrically insulating substrate 3101*b* includes two surfaces along the thickness direction, that is, an upper surface and a lower surface of an electrically insulating substrate 3101*b* shown in FIG. 23; wherein the upper surface is formed with a conductive track 40*b* used for sensing the temperature of the susceptor 30*b*, while the lower surface is formed with a susceptor material layer 3102*b*. In the present embodiment, the electrically insulating substrate 3101*b* may employ materials of high heat conductivity, so that the overall temperature tends to be uniform, thereby enabling the heat transfer to the smokable material A to keep roughly uniform during the heating process and reducing the error of temperature measurement of the conductive track 40*b*.

The above aerosol generation device and the susceptor can accurately detect the temperature of the susceptor when heating the smokable material by responding to the magnetic field; compared with a temperature measuring mode using a temperature sensor, production and preparation are more convenient and rapider, and the temperature measuring effect is more accurate.

It is to be noted that the description of the present disclosure and the drawings just list some preferred embodiments of the present disclosure and are not limited to the embodiments described herein. Further, for the ordinary staff in this field, improvements or variations may be made according to the above description, and these improvements or variations are intended to be covered within the scope of protection of the claims appended hereinafter.

The invention claimed is:

1. An aerosol generation device, configured to heat a smokable material to generate an aerosol, comprising:

a chamber, which is used for receiving at least some of a smokable material;

a magnetic field generator, which is configured to generate a varying magnetic field;

a susceptor, which is configured to be penetrated by the varying magnetic field so as to generate heat, thereby heating the at least some of the smokable material received in the chamber; and a circuit, which is configured to determine the temperature of the susceptor by acquiring a resistance value of at least some of the material on the susceptor and on the basis of the resistance value, wherein the susceptor comprises:

an electrically insulating substrate extending at least in part into the chamber, a susceptor material layer formed on the electrically insulating substrate, and a conductive track in heat conduction with the susceptor material layer, wherein the susceptor material layer is configured to be penetrated by the varying magnetic field so as to generate heat, thereby heating the at least some of the smokable material received in the chamber;

wherein the conductive track has one of a positive and a negative temperature coefficient of resistance; and wherein the circuit is configured to determine the temperature of the susceptor by acquiring a resistance value of the conductive track and on the basis of the resistance value.

2. The aerosol generation device according to claim 1, wherein the circuit comprises:

a first power supply module, which is configured to provide an alternating current to the magnetic field generator, so that the magnetic field generator generates a varying magnetic field;

a second power supply module, which is configured provide to a direct-current detection voltage to the susceptor; and a detection module, which is configured to determine the temperature of the susceptor by detecting a resistance value of the susceptor under the detection voltage and on the basis of the resistance value.

3. The aerosol generation device according to claim 1, wherein the susceptor is constructed as one of a pin, a needle and a sheet shape extending at least in part along an axial direction of the chamber.

4. The aerosol generation device according to claim 1, wherein the susceptor represents a tubular shape, and at least part of an inner surface of the susceptor forms the chamber.

5. The aerosol generation device according to claim 1, wherein the susceptor further comprises a base portion, and the aerosol generation device provides supporting for the susceptor through the base portion.

6. The aerosol generation device according to claim 1, wherein the electrically insulating substrate is constructed as a blade shape extending along an axial direction of the chamber and comprises a first surface and a second surface that are opposite to one another along a thickness direction; wherein the susceptor material layer is formed on the first surface, and the conductive track is formed on the second surface.

7. The aerosol generation device according to claim 1, wherein the conductive track has two ends provided with an electrical connection part and is electrically connected to the circuit through the electrical connection part.

8. The aerosol generation device according to claim 7, wherein the conductive track comprises a first portion and a second portion, and the first portion has a higher temperature coefficient of resistance than the second portion; and the electrical connection part is connected to the conductive track through the second part.

9. The aerosol generation device according to claim 8, wherein the first portion comprises at least one of nickel iron copper alloy, nickel chromium aluminum alloy, nickel chromium copper alloy, platinum or tungsten;

and/or, the second portion comprises at least one of gold, silver or copper.

10. The aerosol generation device according to claim 1, further comprising a tubular support, wherein at least part of an inner space of the tubular support forms the chamber;

the magnetic field generator comprises an induction coil arranged on an outer surface of the tubular support along an axial direction of the tubular support; and the conductive track is formed on the inner surface of the tubular support.

11. The aerosol generation device according to claim 10, wherein an insulating flexible carrier is arranged between the inner surface of the tubular support and the susceptor; and the conductive track is formed on the insulating flexible carrier.

12. The aerosol generation device according to claim 2, wherein the susceptor comprises:

a susceptor portion, which is configured to be penetrated by the varying magnetic field so as to generate heat, thereby heating the smokable material received in the chamber; and an electrical connection portion arranged on the susceptor portion and configured to be electrically connected to the circuit.

13. The aerosol generation device according to claim 12, wherein the electrical connection portion has a positive temperature coefficient of resistance; and the detection module is configured to determine the temperature of the susceptor by detecting a combined resistance value of the susceptor portion and the electrical connection portion and on the basis of the combined resistance value.

14. The aerosol generation device according to claim 12, wherein the electrical connection portion comprises a first section and a second section that are arranged in sequence, and the first section has a higher temperature coefficient of resistance than the second section; wherein the first section of the electrical connection portion is connected to the susceptor portion; and the second section of the electrical connection portion is electrically connected to the circuit.

15. The aerosol generation device according to claim 11, wherein the susceptor portion defines thereon at least one gap along a length direction.

16. A susceptor for an aerosol generation device, wherein the susceptor is configured to be penetrated by a varying magnetic field so as to generate heat, thereby heating a smokable material in a chamber of the aerosol generation device, comprising:

an electrically insulating substrate configured to extend at least in part into the chamber of the aerosol generation device;

a susceptor material layer formed on the electrically insulating substrate; wherein the susceptor material layer is configured to be penetrated by the varying magnetic field so as to generate heat, thereby heating at least some of the smokable material in the chamber; and a conductive track in heat-conducting connection with the susceptor material; wherein the conductive track has one of a positive and a negative temperature coefficient of resistance, wherein a resistance value of the conductive track is indicative of a temperature of the susceptor.

17. A susceptor for an aerosol generation device, wherein the susceptor is configured to be penetrated by a varying magnetic field so as to generate heat, thereby heating a smokable material in a chamber of the aerosol generation device, comprising:

an electrically insulating substrate configured to extend at least in part into the chamber of the aerosol generation device;

a susceptor portion, which is formed on the electrically insulating substrate and configured to be penetrated by the varying magnetic field so as to generate heat, thereby heating at least some of the smokable material in the chamber; and an electrical connection portion arranged on the susceptor portion for providing a direct-current detection voltage to the susceptor, wherein the electrical connection portion is configured to conduct a direct current under the direct-current detection voltage, wherein a resistance value of the electrical connection portion is indicative of a temperature of the susceptor.

* * * * *